US011318428B2

(12) United States Patent
Leloup

(10) Patent No.: US 11,318,428 B2
(45) Date of Patent: May 3, 2022

(54) METHOD AND DEVICE FOR MIXING COMPONENTS FOR MANUFACTURING A CUSTOMISED PRODUCT

(71) Applicant: L'OREAL (SAS), Paris (FR)

(72) Inventor: David Leloup, Troyes (FR)

(73) Assignee: L'OREAL (SAS), Paris (FR)

( * ) Notice: Subject to any disclaimer, the term of this patent is extended or adjusted under 35 U.S.C. 154(b) by 124 days.

(21) Appl. No.: 16/067,059

(22) PCT Filed: Jan. 5, 2017

(86) PCT No.: PCT/FR2017/000002
§ 371 (c)(1),
(2) Date: Jun. 28, 2018

(87) PCT Pub. No.: WO2017/118799
PCT Pub. Date: Jul. 13, 2017

(65) Prior Publication Data

US 2019/0022610 A1 Jan. 24, 2019

(30) Foreign Application Priority Data

Jan. 5, 2016 (FR) ..... 16 00014

(51) Int. Cl.
*B01F 5/00* (2006.01)
*B01F 5/06* (2006.01)
*B01F 15/00* (2006.01)

(52) U.S. Cl.
CPC ..... *B01F 5/0685* (2013.01); *B01F 15/00025* (2013.01); *B01F 2215/0031* (2013.01)

(58) Field of Classification Search
CPC ..... B01F 5/0685; B01F 15/00025; B01F 2215/0031
See application file for complete search history.

(56) References Cited

U.S. PATENT DOCUMENTS 6,062,722 A * 5/2000 Lake ..... B01F 5/0615 366/130
2011/0196232 A1* 8/2011 Kim ..... A61M 5/2053 600/432

FOREIGN PATENT DOCUMENTS

| | | |
|---|---|---|
| FR | 2998193 | 5/2014 |
| NL | 2006787 | 11/2012 |
| WO | 2010086698 | 8/2010 |

* cited by examiner

*Primary Examiner* — Anshu Bhatia

(57) ABSTRACT

The invention concerns a device 51 for mixing at least two components, characterised by the fact that the mixing device 51 comprises two containers 52 and 53 each provided with: a. at least one opening 110 connected by a conduit 55 and provided with a device allowing the available volume of the containers 52 and 53 to be varied alternately, pistons 50 that are able to be moved in opposing directions, so as to transfer the content from one of the containers 52 or 53 into the other container 52 or 53 through the openings 110 and the conduit 55; and b. at least one inlet opening X allowing the at least two components to enter; said mixing device not comprising an additional outlet opening, one of the inlet openings X allowing both at least one component to enter, and the mixture of the at least two components obtained to leave. The invention also concerns a method for mixing cosmetic components using this mixing device and a device for manufacturing and dispensing a customised cosmetic composition comprising said mixing device.

13 Claims, 4 Drawing Sheets

Figure 1:
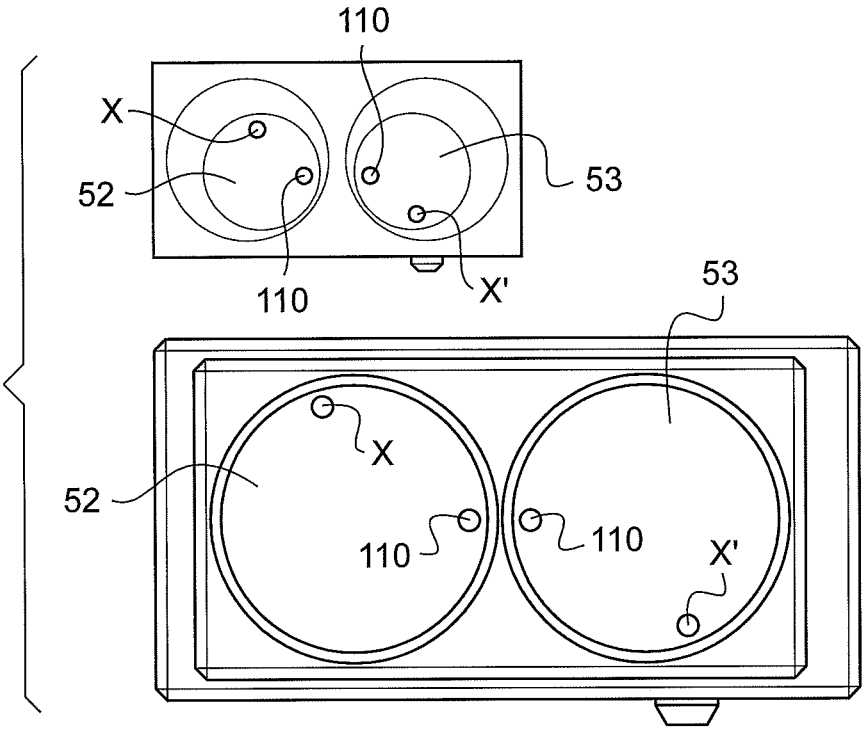

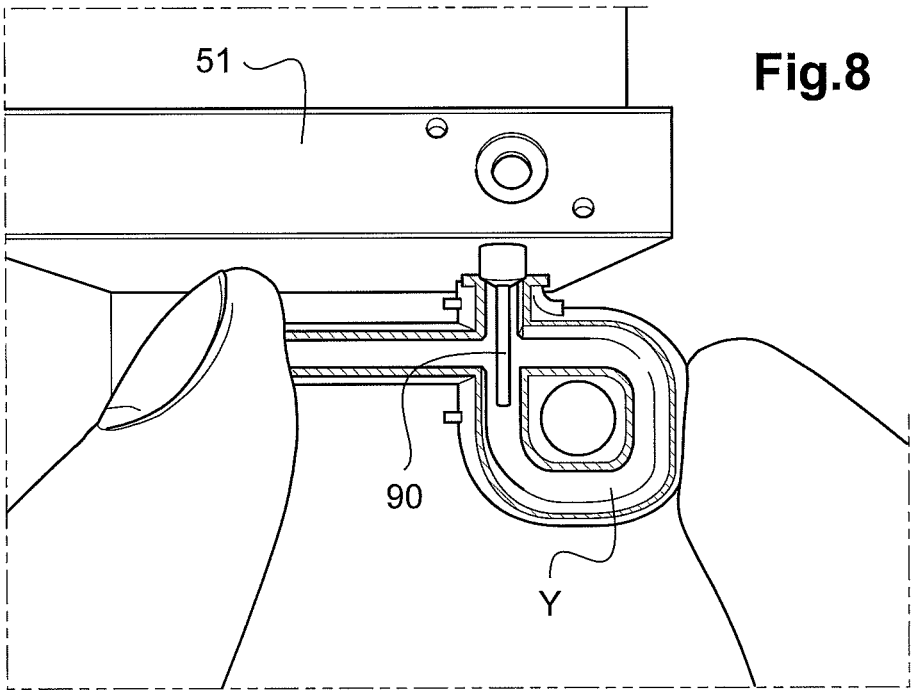
Fig.8
Fig.9
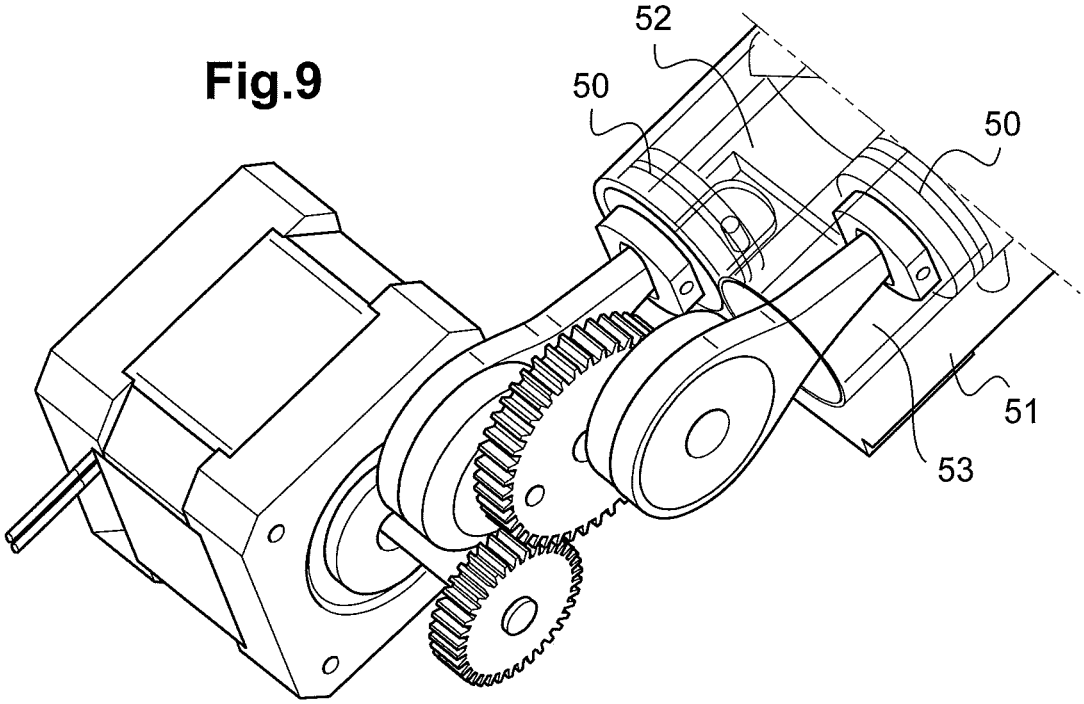

METHOD AND DEVICE FOR MIXING COMPONENTS FOR MANUFACTURING A CUSTOMISED PRODUCT

CROSS-REFERENCE TO RELATED APPLICATIONS

This application is a § 371 national stage entry of International Application No. PCT/FR2017/00002, filed Jan. 5, 2017, which claims priority to French Patent Application No. 16/00014, filed Jan. 5, 2016, the entire contents of which are incorporated herein by reference.

The present invention concerns a mixing device and a process for mixing homogeneously components, preferably cosmetics, for the manufacturing of a customised product, preferably cosmetic product.

The invention concerns in first place a mixing device 51 of at least two components characterized in that the mixing device 51 comprises two receptacles 52 and 53 each equipped with a. at least one orifice 110 linked by a pipe 55 and fitted with a device allowing to vary alternately the available volume of the receptacles 52 and 53, in such way to transfer the content of the receptacles 52 or 53 in the other receptacle 52 or 53 by the orifice 110 and the pipe 55.

b. Pistons 50 likely to be animated with opposed movements to transfer the contents of one of the receptacles 52 or 53 in the other receptacle 52 or 53 by the orifice 110 and the pipe 55.

c. at least one entry orifice X allowing entry of at least two components;

the said mixing device, does not include an additional exit orifice, one of the entry orifice X allowing both the entry of at least one component and the exit of the obtained mixture of at least two components.

By device allowing to vary alternatively the available volume of receptacles 52 and 53, it is intended to designate according to the present invention a device allowing to increase the available volume of receptacle 52 when the volume of the receptacle 53 decreases and vice versa. Preferably according to the invention, such device includes pistons 50, likely to be animated by opposite movements to vary the available volume of receptacles 52 or 53. Advantageously according to the invention, said device consists of motor-driven rolls that crush alternatively receptacle 52 and receptacle 53, said receptacles 52 and 53 being then made of a soft material, like a flexible plastic pocket.

Preferably, the device according to the invention is characterized in that at least one entry orifice X is comprised in the receptacle 52 and is intended to the entry of the at least one active cosmetic component and at least one other entry orifice X is comprised in the receptacle 53 and is intended for the entry of the at least one base cosmetic component and for the exit of the obtained mixture of the at least two cosmetic components, said entry and exit orifice X being named X'.

By components it is intended to designate according to the present invention liquids of viscosity that can be of different viscosity within a range from 1 centipoise or 1 mPa·S (as water, for example) to 500 000 mPa·s (like butter at 10° C., viscosity measured with Brookfield DVIII Ultra, needle F, speed 1.5), as well as powders, whose maximum grain size is defined by the size of the entry orifice X and X' and the orifice 110, in a way not to obstruct them. Preferably, it is selected at least one compound in a liquid form. It may for example be a mixture of liquid paint and pigments in a powder form, a mixture of precursor of hair coloration, for example an oxidizer, a base and a coupler for a composition of hair coloration, mixture of two cosmetic foundation from different color to obtain a foundation of the desired color, mixture of a base cosmetic cream and one or more active agent(s), or also a mixture of an alimentary base sauce and a liquid aroma, or a mixture of alimentary alcohol, of a fruit juice and an alimentary syrup or liquor for a cocktail manufacture.

Advantageously according to the invention, the at least two components are at least two cosmetic components, preferably at least a base component and at least one, two, three, four, five, or at least six active components. In a preferred particular manner, the at least two components are at least a base component and at least one, two, or three active components.

By "base component", it is referred to a cosmetic component whose purpose is to bring a particular texture (cream, serum, oil, etc.) to the cosmetic product. It can be a single ingredient (for example, sweet almond oil) or several ingredients (such as water, sweet almond oil and an emulsifying agent) to obtain the said particular texture.

By "active component", it is meant a cosmetic component whose purpose is to bring at least a particular activity (anti-aging, moisturizing, antioxidant, etc.). It can be one or several active ingredients combined to obtain the said particular activity.

The mixing device according to the invention allows then to obtain within a short period, preferably less than 30 seconds, more preferably less than 15 seconds, a mixture of at least two components, preferably cosmetics components, which is perfectly homogeneous, even if it is prepared in small quantities (typically in the order of about $cm^3$ or less), with a little space used and a good robustness to wear. In particular, this mixing device, is integrated in a manufacturing and distribution device allowing the production of a product, preferably cosmetic product, personalized with similar characteristics.

Advantageously, the mixing device according to the invention comprises a reduced number of orifices, allowing to limit the number of orifices to clean and the risk of occlusion. Thus, this mixing device does not include a dedicated exit orifice, but one of the entry orifice X' which allows both the entry of at least one component and the exit of the obtained mixture of at the least two components.

The receptacles of the mixing device according to the invention can have varied form, cylindrical, oval, cubical, spherical, rectangular. Preferably, these receptacles are oval or cylindrical, which makes cleaning easier and allows to obtain a more homogeneous mixture.

The oval-shaped receptacles have the technical advantage of a smaller space used by the mixing device than the cylindrical shaped receptacles. They thereby allow to also obtain a manufacturing and cosmetic product distribution device with smaller space used than the one with other forms as for example a cylindrical form.

These receptacles must each have an orifice 110 and a pipe 55 linking them to allow the mixture of the at least two components. However, there is no technical constraint on the position of these receptacles with respect to each other, these receptacles can be for example either spaced, bunk, placed face to face or parallel. In addition, the pipe 55 can be formed by a valve 57 connecting the two orifices and allowing to open and close said orifices.

According to one aspect of the invention, the receptacles of the mixing device can be flexible pockets. These pockets are preferably in flexible plastic, especially elastic.

Preferably according to the invention, the entry orifice X is comprised in the receptacle 52 and is intended for the entrance of the at least one active cosmetic component and the entry orifice X' is included in the 53 receptacle and is intended for the entrance of the at least one base cosmetic component and the exit of the mixture obtained of at the least 2 cosmetic components.

In a preferred embodiment according to the invention, said device allowing to vary alternatively the available volume of receptacles 52 and 53, preferably said pistons 50, are driven by an actuator.

Also in a specific embodiment, the mixing device according to the invention comprises at least a valve 57.

According to another mode of realisation, the mixing device according to the invention comprises at least two main valves 56 and 56' and at least one auxiliary valve 57. Preferably the valves are fitted with two bores each. Preferably, the device includes two main valves 56 and 56' and an auxiliary valve 57 with two bores each.

These at least three valves 56, 56' and 57 so pierced allow in particular to ensure the clean-up of said device without the need to add a water pump, or sprinkler powered by said water pump to bring water inside the device. It's the mixing device that will aspire itself the water necessary to its cleaning, thanks to the said valves and the piston, in a step of self-cleaning.

In a particularly preferred embodiment according to the invention, the valves, and in particular the at least 3 valves 56, 56' and 57 of the mixing device according to the invention are diaphragm valves, slide gate valves, pinch valves, knife gate valves or ball valves, preferably slide gate valves. Such valves allow to optimize the sealing of the device and get a very good sealing, notably considerably improved compared to the use of other valves conventionally used by the skilled person, in particular the slide gate valves. This improved sealing allows the step of self-cleaning of the mixing device 51, without water pump, with all the required sealing.

In a preferred embodiment according to the invention, the mixing device according to the invention comprises an auxiliary valve 57 fitted with at least two bores sliding in a pipe arranged in the mixing device and the said valve 57 is likely to be driven in translation by a rack system 61, preferably powered by a motor 62, and able to control the flow between the said two receptacles 52 and 53.

The use of racks allows to entail the said valves in a translational movement, while allowing to maintain a minimal space used by said device.

Preferably, the valve 56 posses 2 bores, sliding in a pipe arranged in the mixing device, one of the bore allowing access of cleaning water, in order to penetrate the water into the mixing device 51 for the cleaning of the said device (we talk about a valve 56 in washing position), and the other bore allowing access to the hollow needle, either to introduce a component, preferably a component of active agent in said mixing device, or to extract the cleaning water by the hollow needle and thus clean it (this refers to a valve 56 in open position).

Preferably, the valve 56' has 2 bores, sliding in a pipe arranged in the mixing device, one of the bore allowing access to the component, preferably the base component, and the other bore allowing access to the supply nozzle of the product there from obtained by mixture, preferably the custom cosmetic product.

A second object of the present invention concerns a device for the manufacturing and the distribution of a custom cosmetic product, the said product being manufactured by mixture of at least two cosmetic components, characterized in that the said device comprises a mixing device 51 according to the invention.

The device for the manufacture and distribution of a custom cosmetic product according to the invention includes in addition of the mixing device 51, at least two containers (11, 103) housing respectively each one of the at least two cosmetic components. This manufacturing and distribution device includes advantageously as many containers as cosmetic components. Preferably, the active components are contained in containers (103) and the base components are contained in containers (11). Also, in an advantageous embodiment, the containers of base components include an exit orifice.

As a mean of transfer of the component, preferably active cosmetic component, to the mixing device (51), the device according to the invention may include at least a main valve 56 fit, in one of its positions, to connect a hollow needle 90 with the mixing device, in one of its positions to obstruct the orifice of the mixing device during the mixing phase, in another of its positions to connect cleaning channel with the mixing device and at least a second main valve 56' able to provide the said product, preferably cosmetic product, to an user through a distribution nozzle.

In a preferred embodiment according to the invention, the device for the manufacture and distribution of a custom cosmetic product includes in addition a cleaning device of the said mixing device comprising a. a water tank connected to the orifice X, allowing entry of water into the receptacle 52 of the mixing device 51,
b. a gutter linking the entry and exit orifice X' to a collecting tank allowing the evacuation of the water resulting from the washing from the receptacle 53.
c. a hollow circular-shaped device Y connecting the entry orifice X to a water collecting tank resulting from the washing allowing the evacuation of the receptacle 52 of the water resulting from the washing.

In a similar manner, it will be used the terms cleaning or washing according to the present invention.

Advantageously, the cleaning water can be heated beforehand for a better cleaning, or can be replaced or added with a cleaning agent such as an antibacterial agent and/or a detergent. It can be added to the cleaning water, for example, sodium hydroxide, the device being then rinsed in an extra step with clear water.

A third object of the present invention concerns a process for the manufacture by mixing of at least two cosmetic components and the distribution of a customized cosmetic product, the said process comprising the steps consisting in:

bring to a mixing device 51 according to the present invention at least one base cosmetic component in the receptacle 53 thanks to the orifice X';

Channel through the movement of the device allowing to vary alternatively the available volume of the receptacles 52 and 53, preferably by the movement of the pistons 50, the said base cosmetic component of the receptacle 53 to the receptacle 52 by the pipe 55 linking the two orifices 110;

perform a degassing of the receptacle 52 by a movement of the piston 50 in such way to evacuate the air present into the receptacle 52 by the orifice X;

bring to the said mixing device 51 at least an active cosmetic component into the receptacle 52 through the orifice X;

achieve a homogeneous mixture of the cosmetic components by activating the motor 62 to bring alternatively, through the device movement allowing to vary the volume of available receptacles 52 and 53, preferably by the opposite movement of the pistons 50, components of the receptacles 52 and 53 by the pipe 55 linking the two orifices 110, ending with the said cosmetic components mixture into the receptacle 53;

distribute the cosmetic product thus manufactured to the user by a movement of the device allowing to vary alternatively the available volume of receptacles 52 and 53, preferably by the movement of the piston 50 in such way to evacuate the product cosmetic by the orifice X' to the user;

Optionally wash the mixing device by a step of cleaning.

The volume of custom cosmetic product obtained by the invention can be for one dose for one use, for example immediately by the user, or multiple doses, for multiple uses, in this case the product may be stored in a container by the consumer. In the case where the volume of cosmetic product is one dose, it will be typically a volume in the order of ml, and in the particular case of a cosmetic products for a face use, a volume of about 1 ml. In this case of figure of a volume of cosmetic product of 1 ml, the volume of the pipe 55 in the valve 57 can be about 0, 05 ml, and it will be advantageous to realise at least 3, advantageously 3 to 6, back and forth of the cosmetic components between the receptacles 52 and 53 (by operating the motor 62 so that to bring alternatively, through the device movement allowing to vary alternatively the available volume of receptacles 52 and 53, preferably by the opposite movement of the pistons 50, the components of receptacles 52 and 53 through the pipe 55 linking the two orifices 110) in order to achieve a homogeneous mixture of the cosmetic components.

It will be described now, as non-limiting example, a mode of performing the invention with reference to the schematic drawings annexed in which:

The FIG. 1 is a front view of the mixing device 51 without the pistons.

Figure 2:
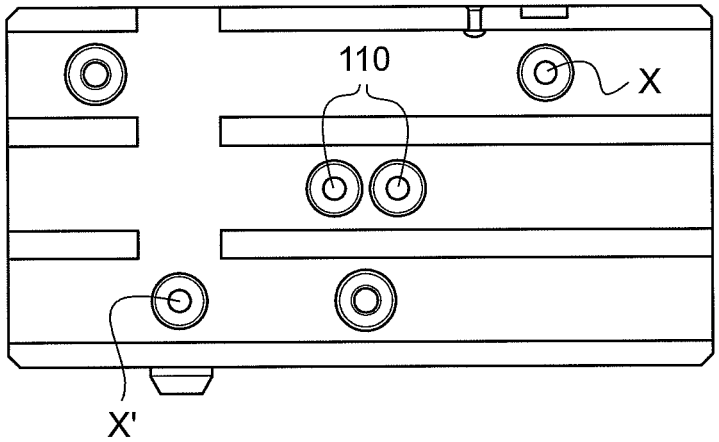
Figure 2:
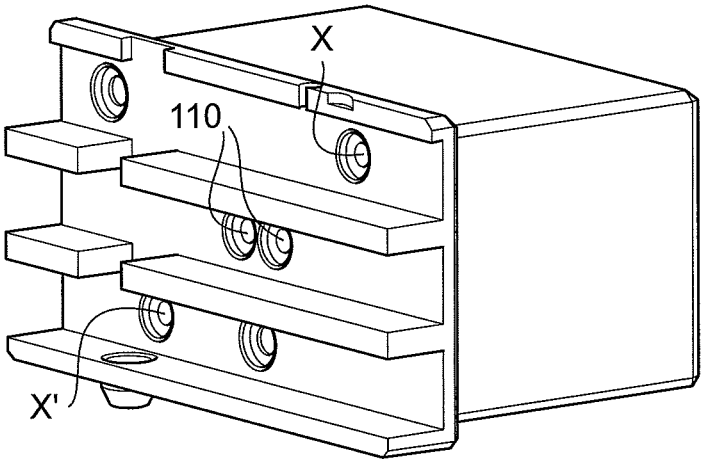

The FIG. 2 is a rear view of the mixing device 51.

The FIG. 2' is a rear view ¾ of the mixing device 51.

Figure 3:
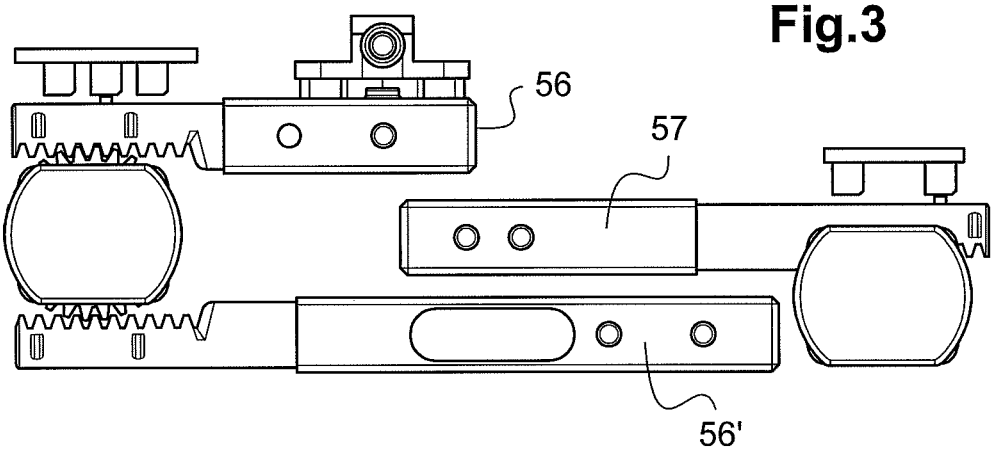
Figure 3:
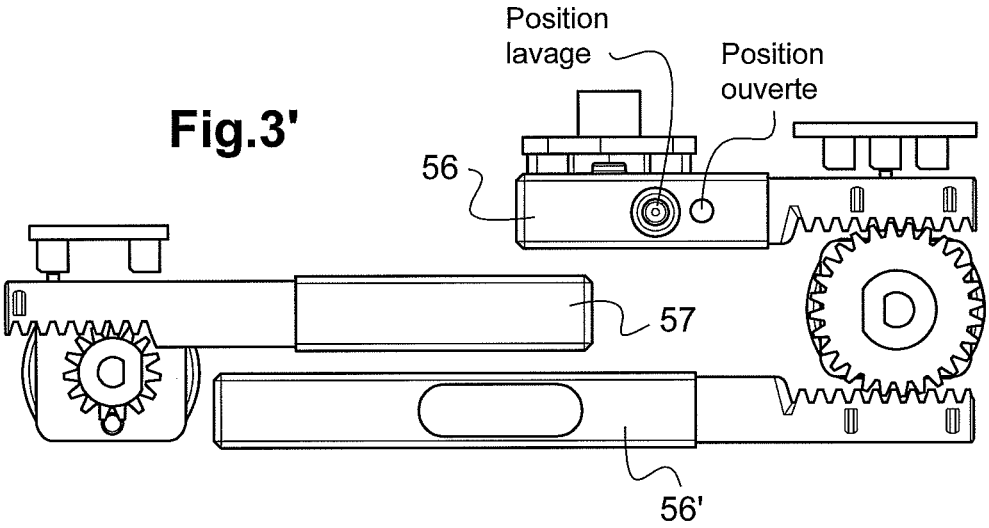

The FIGS. 3 and 3' represent the main valves 56 and 56' and an auxiliary valve 57, front face (FIG. 3) and rear face (FIG. 3'). It can be distinguished on FIG. 3, valve 56, the open positions allowing access of the cosmetic component into the receptacle 52, and the washing position allowing access to the cleaning water.

Figure 4:
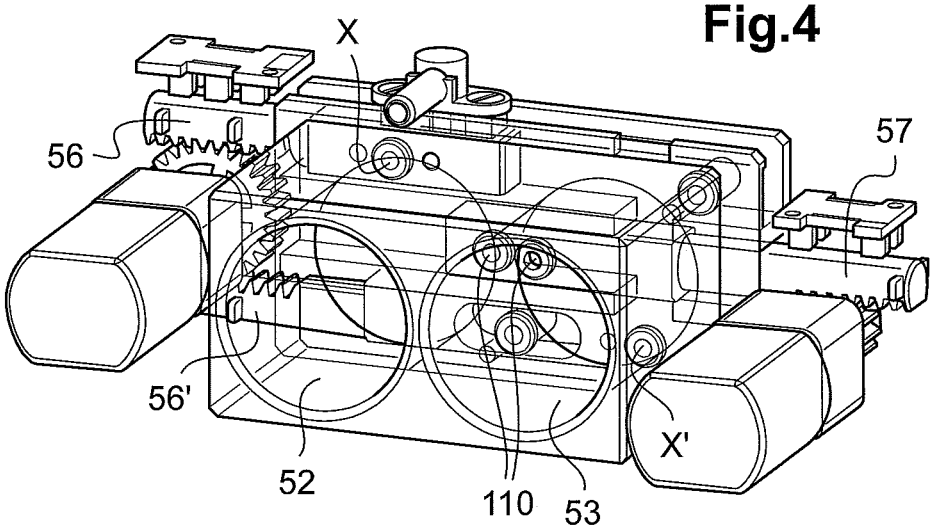

The FIG. 4 represents, in perspective, the whole mixing device in front panel, the pistons and the receptacles 52 and 53 being represented transparently.

Figure 5:
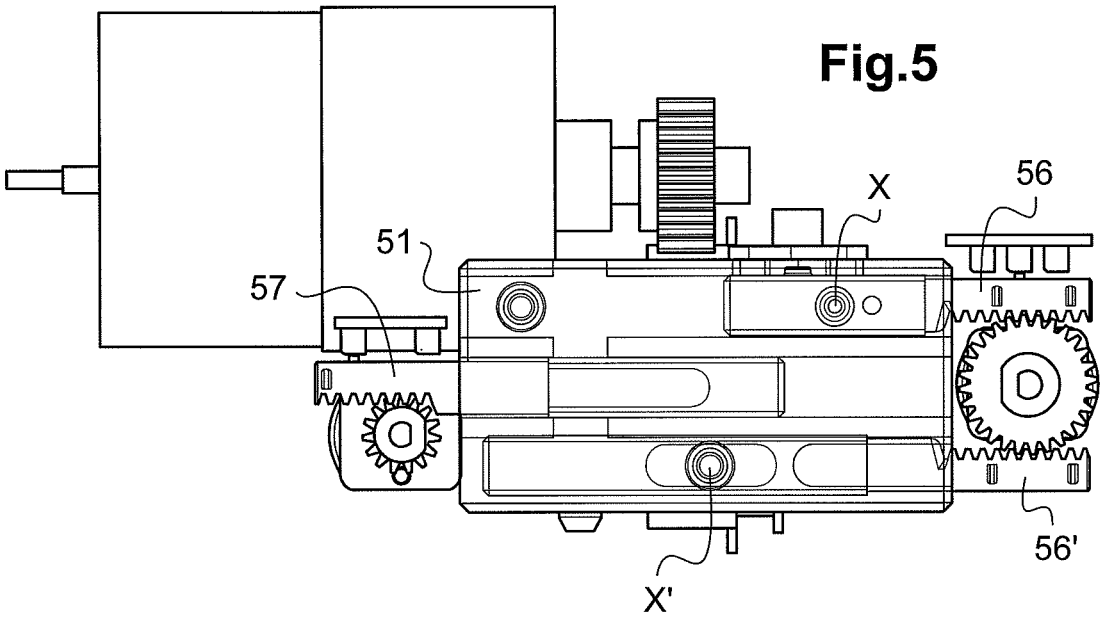

The FIG. 5 represents, in perspective, the whole mixing device in rear panel.

Figure 6:
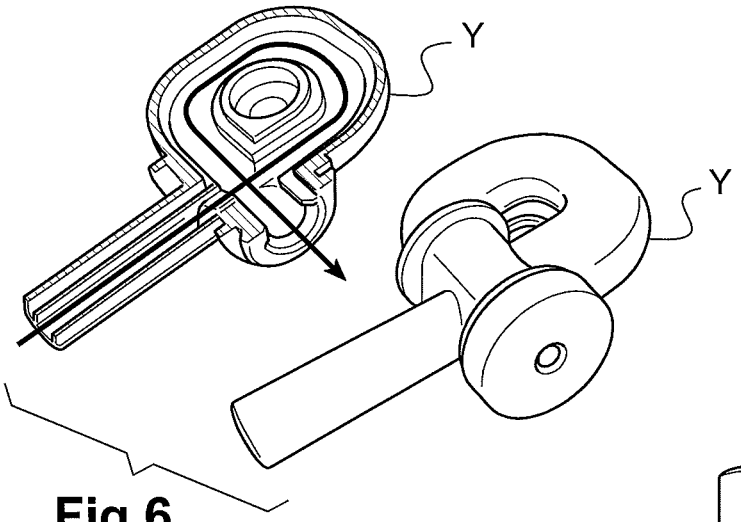

The FIG. 6 represents the circular hollow device for cleaning (presented in horizontal cut at the top of the photo, presented closed such as used in the device according to the invention at the bottom of the photo). It can see on the left the nozzle allowing to insert the hollow needle 90 and with the white arrow the path of the water inside the device Y allowing to clean the inside of the hollow needle 90, then by going through again after the curve, the outside of the hollow needle 90 (at the position where the white arrows cross itself).

Figure 7:
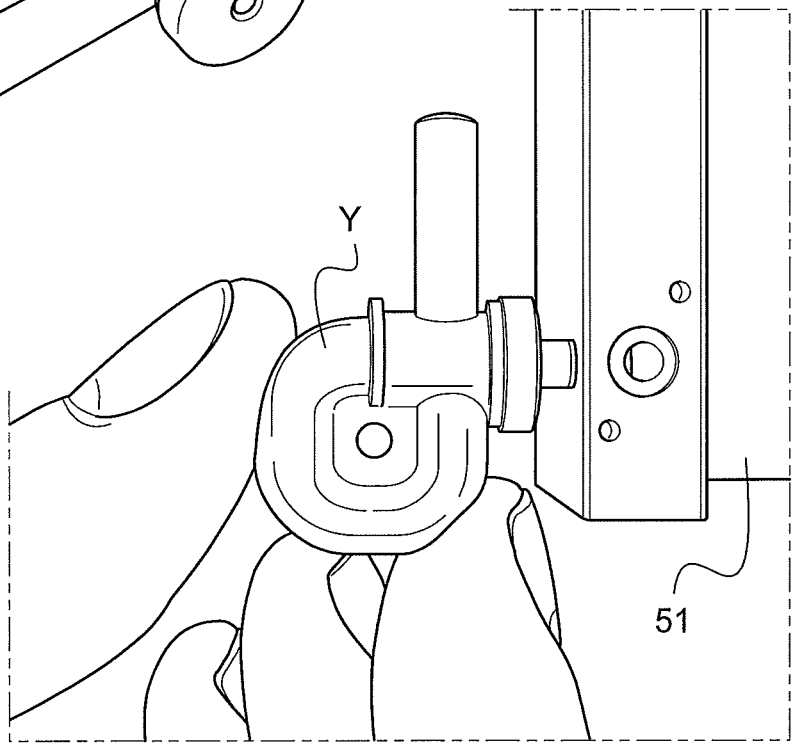

The FIG. 7 represents the circular hollow device for cleaning with the hollow needle inserted inside, in cleaning position (Y presented closed such as used in the device according to the invention at the bottom of the photo).

The FIG. 8 represents the circular hollow device for cleaning with the hollow needle inserted inside, in the position of cleaning (presented in horizontal cut. It can be distinguished the hollow needle 90 inside the device Y).

The FIG. 9 is a view of the mixing device (51) and pistons (50) in action, the piston (50).

Advantageously, the process for the manufacture by mixture of at least two cosmetic components and the distribution of a custom cosmetic product, comprise steps consisting in:

Put the valve 56' in open position using the motor 62 so as to bring to a mixing device 51 at least a base cosmetic component into the receptacle 53 through orifice X'; put the valve 56' in the closed position using the motor 62 allowing to close orifice X';

put the valve 57 in the open position using the motor 62, to open the two orifices 110;

Operate the motor 62 in order to channel by the movement of the device allowing to vary alternately the available volume of the receptacles 52 and 53, preferably by the movement of the piston 50 the said base cosmetic component of the receptacle 53 to the receptacle 52 by the pipe 55 linking the two orifices 110;

put the valve 57 in the closed position using the motor 62, to close the two orifices 110;

put the valve 56 in open position using the motor 62 to open the orifice X and perform a degassing of the receptacle 52 by a movement of the device allowing to vary alternately the volume available to the receptacles 52 and 53, preferably by a movement of the piston 50 in order to evacuate the air in the receptacle 52 by the orifice X;

bring to the said mixing device 51 at least an active cosmetic component into the receptacle 52 through the orifice X with the valve 56 in open position using the motor 62;

bring the valves 56 and 56' in the closed position using the motor 62 to close the orifices X and X';

bring the valve 57 in the open position using the motor 62 to open orifice 110 and pipe 55 achieve a homogeneous cosmetic component using the motor 62 to channel alternatively, through the movement of the device allowing to vary alternately the available volume of receptacle 52 and 53, preferably by the opposite movement of the pistons 50, components of the receptacles 52 and 53 by the pipe 55 linking the two orifices 110, ending with the said mixture of cosmetic components in the receptacle 53;

bring the valve 57 in the closed position and bring the valves 56' in open position using the motor 62 to open the orifice X';

distribute the cosmetic product thus manufactured to the user by a movement of the device allowing to vary alternatively the volume available of receptacles 52 and 53, preferably by the movement of the piston 50 in such way to evacuate the said cosmetic product by the orifice X' to the user;

Optionally wash the mixing device by a step of cleaning.

Advantageously, the cleaning step of the process includes the following steps:

a first step of washing of the receptacles 52 and 53, orifices X and X', from the inside of the valves 56 and 56' and of the pipe 55 preferably included in the valve 57 comprising the following steps:

put the valve in washing position 56 using the motor 62, allowing the orifice X to be in the front of the washing water tank;

aspire through the orifice X until the receptacle 52 the water located in the washing water tank;

put the valve 56 in the closed position, put the auxiliary valve 57 in open position using the motor 62, operate the motor in order to channel alternatively, water by the movement of the device allowing to vary alternatively the available volume of the receptacles 52 and 53, preferably by the opposite movement of the pistons 50, of receptacles 52 to 53, by the pipe 55, preferably included in the valve 57 linking the two orifices 110, then finish with the cleaning water into the receptacle 53, put the valve 57 in the closed position to close orifice 110 put the valve 56' in the open position evacuate the water resulting from the washing through the orifice X' to a collecting tank;

a second step of washing of the receptacle 52, of the orifice X and the inside and the outside of the hollow needle 90 comprising the following steps:

put the valve 57 in the closed position to close orifices 110;

put the valve 56 in washing position using the motor 62, allowing the orifice X of being connected to the washing water tank;

aspire the water located in the washing water tank through the orifice X to the receptacle 52;

put the valve 56 in the open position, allowing the orifice X to be linked to the hollow needle 90;

insert the hollow needle 90 in the hollow circular-shaped device Y linking the orifice X to a tank collecting water evacuate the water by the orifice X and the hollow needle 90 through the hollow circular-shaped device Y allowing to clean the orifice X then the inside of the hollow needle 90, then the outside of the hollow needle 90, the water returning into the device Y on the outside of the hollow needle 90 before its evacuation to a collecting tank of water resulting from the washing.

The invention claimed is:

1. A mixing device (51) of at least two components characterized in that the mixing device (51) comprises two receptacles (52) and (53) each equipped with:

a. at least one orifice (110) linked by a pipe (55) and fitted with a device allowing to vary alternately an available volume of the receptacles (52) and (53) to transfer content of one of the receptacles (52) or (53) to the other receptacle (52) or (53) by the orifices (110) and the pipe (55); and b. at least one entry orifice (X) allowing entry of one of the at least two components, wherein the mixing device does not include an additional exit orifice, wherein one of the entry orifices (X) allows both the entry of at east one component and the exit of a mixture of the at least two components, wherein the mixing device further comprises at least two main valves each respectively coupled to the at least one entry orifices of the receptacles and at least an auxiliary valve coupled to the pipe linking the at least one orifices of the respective receptacles, and wherein the auxiliary valve controls the flow of the at least two components between the receptacles.

2. The mixing device (51) according to claim characterized in that the receptacles are in an oval-shaped or cylindrically shaped.

3. The mixing device (51) according to claim 1 characterized in that the at least two components are at least two cosmetic components.

4. The mixing device (51) according to claim 1 characterized in that the at least one entry orifice (X) is comprised in one of receptacles and is configured to receive at least one active cosmetic component and in that the other at least one entry orifice (X) is comprised in the other receptacle (53) and is configured to receive at least one base cosmetic component and an exit of a mixture obtained from the at least one active cosmetic component and the at least one base cosmetic component.

5. The mixing device (51) according to claim 1 further comprising the auxiliary valve (57) fitted with at least two bores sliding in the pipe arranged in the mixing device and the auxiliary valve (57) is driven in translation by a rack system (61) to control the flow between the two receptacles (52) and (53).

6. The mixing device (51) according to claim 1, wherein the auxiliary valve (57) and two main valves (56) and (56') comprise diaphragm valves, slide gate valves, pinch valves, knife gate valves, or ball valves.

7. A device for the manufacturing and the distribution of a custom cosmetic product, the product being manufactured by mixture of at least two cosmetic components characterized in that the device comprises the mixing device (51) according to claim 1.

8. The device for the manufacturing and the distribution of the custom cosmetic product according to claim 7 further comprising a cleaning device of the mixing device, the cleaning device comprising:

a water tank connected to the entry orifice (X) of the one receptacle, allowing entry of water into the one receptacle (52) of the mixing device (51), gutter linking the entry and exit orifice (X') of the other receptacle to a water collecting tank allowing the evacuation of the water resulting from the washing from the other receptacle (53), and a hollow circular-shaped device (Y) connecting the entry orifice (X) to the water collecting tank resulting from the washing allowing the evacuation of the one receptacle (52) of the water resulting from the washing.

9. The mixing device (51) according to claim 1 characterized in that the at least two components are at least a base component and at least one, two, three, four, five, or at least six active components.

10. Process for the manufacture by mixing of at least two cosmetic components and the distribution of a customized cosmetic product, the said process comprising the steps consisting in:

bring to a mixing device 51 according to claim 1, at least one base cosmetic component in the receptacle 53 thanks to the orifice X';

channel through the movement of the device allowing to vary alternatively the available volume of the receptacles 52 and 53, the said base cosmetic component of the receptacle 53 to the receptacle 52 by the pipe 55 linking the two orifices 110;

perform a degassing of the receptacle 52 by a movement of the device allowing to vary alternatively the available volume of the receptacles 52 and 53 in such way to evacuate the air present into the receptacle 52 by the orifice X;

bring to the said mixing device 51 at least an active cosmetic component into the receptacle 52 through the orifice X;

achieve a homogeneous mixture of the cosmetic components by activating the motor 62 to bring alternatively, through the device movement allowing to vary the volume of available receptacles 52 and 53, components of the receptacles 52 and 53 by the pipe 55 linking the two orifices 110, ending with the said cosmetic components mixture into the receptacle 53;

distribute the cosmetic product thus manufactured to the user by a movement of the device allowing to vary alternatively the available volume of receptacles 52 and 53 in such way to evacuate the product cosmetic by the orifice X' to the user;

optionally wash the mixing device by a step of cleaning.

11. The process of claim 10, wherein the available volume of the available volume of the receptacles 52 and 53 is varied alternatively by the movement of the pistons 50.

12. The process of claim 10, wherein the method comprises the step of washing the mixing device by a step of cleaning.

13. A system comprising:

a mixing device configured to manufacture and distribute a cosmetic product based on a mixture of at least two cosmetic components, the mixing device comprising: two receptacles each comprising:

one orifice linked by a pipe and fitted with a device configured to alternately vary an available volume of the receptacles to transfer content of one of the receptacles to the other receptacle, via the orifices and the pipe, and at least one entry orifice allowing entry of the at least two cosmetic components, wherein one of the entry orifices is configured to allow both an entry of at least one of the at least two cosmetic components and an exit of an obtained mixture of the at least two cosmetic components; and a cleaning device comprising:

a water tank connected to the entry orifice allowing entry of water into the receptacle of the mixing device, a gutter linking the at least one entry orifice of one of the two receptacles to a water collecting tank, allowing the evacuation of the water resulting from washing the one of the two receptacles, and a hollow circular-shaped device connecting the at least one entry orifice of the other receptacle to the water collecting tank, allowing the evacuation of the water resulting from washing the other of the two receptacles.

* * * * *